US010314760B1

(12) United States Patent
Bodman

(10) Patent No.: US 10,314,760 B1
(45) Date of Patent: Jun. 11, 2019

(54) INFLATABLE CRUTCH AIR CUSHION

(71) Applicant: Mobb Health Care Ltd Corporation, Concord, Ontario (CA)

(72) Inventor: Moshe Bodman, Toronto (CA)

(73) Assignee: Mobb Health Care Ltd Corporation, Concord (CA)

( * ) Notice: Subject to any disclaimer, the term of this patent is extended or adjusted under 35 U.S.C. 154(b) by 0 days.

(21) Appl. No.: 16/014,835

(22) Filed: Jun. 21, 2018

(51) Int. Cl.
*A61H 3/02* (2006.01)

(52) U.S. Cl.
CPC ... *A61H 3/0277* (2013.01); *A61H 2003/0283* (2013.01); *A61H 2201/0103* (2013.01)

(58) Field of Classification Search
CPC ..... A61H 3/02; A61H 3/0277
USPC ..... 135/73; 52/2.18, 2.22, 2.23
See application file for complete search history.

(56) References Cited

U.S. PATENT DOCUMENTS 563,358 A * 7/1896 Burdick ..... A61H 3/02 135/73
736,072 A * 8/1903 Cole ..... A61H 3/02 135/73
1,232,057 A * 7/1917 Lineback ..... A61H 3/02 135/73
1,278,664 A * 9/1918 Hunter ..... A61H 3/02 135/73
1,401,305 A * 12/1921 Beecroft ..... A61H 3/02 135/73
1,442,518 A * 1/1923 Bowers ..... B62J 1/26 135/73
1,499,458 A * 7/1924 Hughes ..... A61H 3/02 135/68
1,980,044 A * 11/1934 Fallon ..... A61H 3/02 135/73

(Continued)

FOREIGN PATENT DOCUMENTS

CN 201664399 12/2010
DE 3040285 A * 6/1982

(Continued)

*Primary Examiner* — Robert Canfield
(74) *Attorney, Agent, or Firm* — Greg M. Popowitz; Assouline & Berlowe, P.A.

(57) ABSTRACT

A crutch air cushion device, including an inflatable housing that slides on top of a crutch, where the inflatable housing includes an upper chamber and at least one side chamber, and a valve for air inlet and outlet. The device further includes an upper chamber has an outer surface on the outside of the inflatable housing and an inner surface on the inside of the inflatable housing, and the valve positioned on the inner surface of the upper chamber. A crutch air cushion device, including an inflatable housing with a plurality of air chambers, and a valve positioned on the inner surface of the inflatable housing that contact the upper surface of a crutch. A method of pressurizing a crutch air cushion device, including sliding an inflatable housing on a crutch, inserting air into the inflatable housing through a valve located on an inner surface of the inflatable housing, and filling an upper chamber and at least one side chamber of the inflatable housing with the air. A method further including removing the inflatable housing, modifying the amount of air pressure within the inflatable housing by opening and closing the valve to the user defined comfort level, and reapplying the inflatable air cushion on the crutch.

8 Claims, 8 Drawing Sheets

(56) References Cited

U.S. PATENT DOCUMENTS 2,037,015 A * 4/1936 Fallon ..... A61H 3/02 135/73
3,309,795 A 3/1967 Helmore
4,164,970 A * 8/1979 Jordan ..... A45C 3/00 206/522
4,465,188 A * 8/1984 Soroka ..... B65D 81/052 206/521
4,489,833 A * 12/1984 Bauer ..... F41C 33/06 206/317
4,612,781 A * 9/1986 Swerdon ..... B65D 81/3881 383/110
4,874,093 A * 10/1989 Pharo ..... B65D 81/03 206/522
4,918,904 A * 4/1990 Pharo ..... B65D 81/03 493/931
5,224,924 A 7/1993 Urso
5,272,856 A * 12/1993 Pharo ..... B65D 81/052 53/403
5,560,382 A * 10/1996 Wagner ..... A61H 3/02 135/73
5,704,475 A * 1/1998 Jack ..... A63B 55/406 150/159
5,890,525 A * 4/1999 Shores ..... B60J 11/00 150/166
6,182,826 B1 * 2/2001 Slepian ..... A63B 55/406 150/159
6,283,296 B1 * 9/2001 Newman ..... B65D 81/052 206/522
6,755,568 B2 * 6/2004 Malone ..... B29C 65/18 206/522
7,360,820 B2 * 4/2008 Tellez ..... B60J 11/00 150/166
7,823,729 B2 * 11/2010 Lee ..... B65D 81/03 206/521
8,361,002 B2 1/2013 Branch
8,800,579 B2 8/2014 Severson et al.
9,428,315 B2 * 8/2016 Liao ..... B65D 81/052
2005/0246964 A1 * 11/2005 Graham ..... B60J 11/00 52/2.11
2006/0103165 A1 * 5/2006 Ward ..... B60J 11/00 296/136.02
2007/0074749 A1 4/2007 Jones et al.
2012/0067439 A1 * 3/2012 Vulpitta ..... E03B 9/027 137/381

FOREIGN PATENT DOCUMENTS

GB 191424128 A * 7/1915
GB 100755 A * 7/1916
GB 103412 A * 1/1917
GB 120604 A * 11/1918 ..... A61H 3/02
GB 123913 A * 3/1919
GB 439921 12/1935
GB 844691 A * 8/1960
GB 2521427 A * 6/2015 ..... A47K 3/062

* cited by examiner

INFLATABLE CRUTCH AIR CUSHION

CROSS-REFERENCE TO RELATED APPLICATIONS

N/A

FIELD OF THE INVENTION

The invention broadly relates to an inflatable crutch air cushion device, more specifically to an inflatable crutch air cushion device where the user can regulate the pressure inside the inflatable crutch air cushion, and even more particularly to a method of pressuring a crutch air cushion device sliding an inflatable housing on a crutch, inserting air into the inflatable housing through a valve located on an inner surface of the inflatable housing, and filling an upper chamber and at least one side chamber of the inflatable housing with the air.

BACKGROUND OF THE INVENTION

A crutch is a mobility aid that transfers weight from the legs to the upper body of a person using the crutches. Crutches are commonly used by people who cannot support their weight using their legs, often due to short-term or long-term injuries or disabilities.

One of the most common models of crutch is an underarm or axillary crutch. Axillary crutches had a pad at the top that is placed against the ribcage beneath the armpit. The user then holds the grip on the crutch that runs parallel to the pad. The crutch enables the user to place more, if not all, of their weight on the crutch to decrease the load on their injured or disabled legs.

By placing weight on the crutch pad, the user often experiences discomfort and/or injuries from the crutch. The user's weight is on the crutch while the user is moving, which creates significant friction and pressure between the crutch and the user's armpit. The pressure between the armpit and the crutch increases the frictional force on the armpit while the user moves using the crutch for support. A user's skin and nerves are often harmed due to the contact between the crutch and the armpit area of the body.

Some people using crutches place a towel or other soft material on top of the crutch pad to help prevent or reduce injuries to the armpit or body. Over time, the cushion of the towel degrades because the weight of the user repeatedly pressing on the towel during use compresses and compacts the towel. In addition, the towel material wears down and loses it springiness. Another drawback of the use of a towel is that a towel is bulky when positioned on the crutch, which negatively impacts the fit between the user's armpit and the top of the crutch.

The use of towels and other soft materials reduces the chances of injury while using crutches, but it is not secure. Towels can move, which can result in the crutch slipping from the user's armpit and causing further injury. In some cases, people duct tape a towel to the top of the crutch pad. These are rudimentary fixes that can cause further injury and do little to solve the actual problem of injury to the user's armpits when using crutches.

As can be derived from the variety of devices and methods directed at protecting the user's armpit while using crutches, many means have been contemplated to accomplish the desired end, i.e., towels and soft materials. Heretofore, tradeoffs between reliability and comfort were required. Thus, there is a long-felt need for a device that protects the user's armpits while using crutches. There is a further long-felt need for a device that allows each user to customize the padding between the armpit and the crutch. There is also a long-felt need for a method to place a device on a crutch that offers customizable padding support between the armpit and the crutch.

BRIEF SUMMARY OF THE INVENTION

The present invention broadly comprises a unitary inflatable housing that slides on top of a crutch, where the inflatable housing includes an upper chamber and at least one side chamber, and a valve for air inlet and outlet.

In a further embodiment, the unitary inflatable housing includes a plurality of air chambers, and a valve positioned on the inner surface of the inflatable housing that contact the upper surface of a crutch.

It is a general object of the present invention to provide a process of using an inflatable housing that includes inserting air into an inflatable housing through a valve located on an inner surface of the inflatable housing, filling an upper chamber and at least one side chamber of the inflatable housing with the air, and sliding the inflatable housing on the top portion of a crutch.

It is a further object of the present invention to reduce the pressure between the user and the crutch.

It is a general objection of the present invention to reduce the rehabilitation time and healing time of the user that needs a crutch for support after an injury. Users are more inclined to use a crutch, as recommended by medical staff, when it is comfortable to use. The present invention reduces additional injury or rehabilitation time that results from the injury not healing properly when the user does not use the crutch due to discomfort.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention.

While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "crutch" is synonymous with terms such as "walking stick", "cane", "brace", "staff", "stick", etc., and such terms may be used interchangeably as appearing in the specification and claims. Although any methods, devices or materials similar or equivalent to those described herein can be used in the practice or testing of the invention, the preferred methods, devices, and materials are now described.

Figure 8:
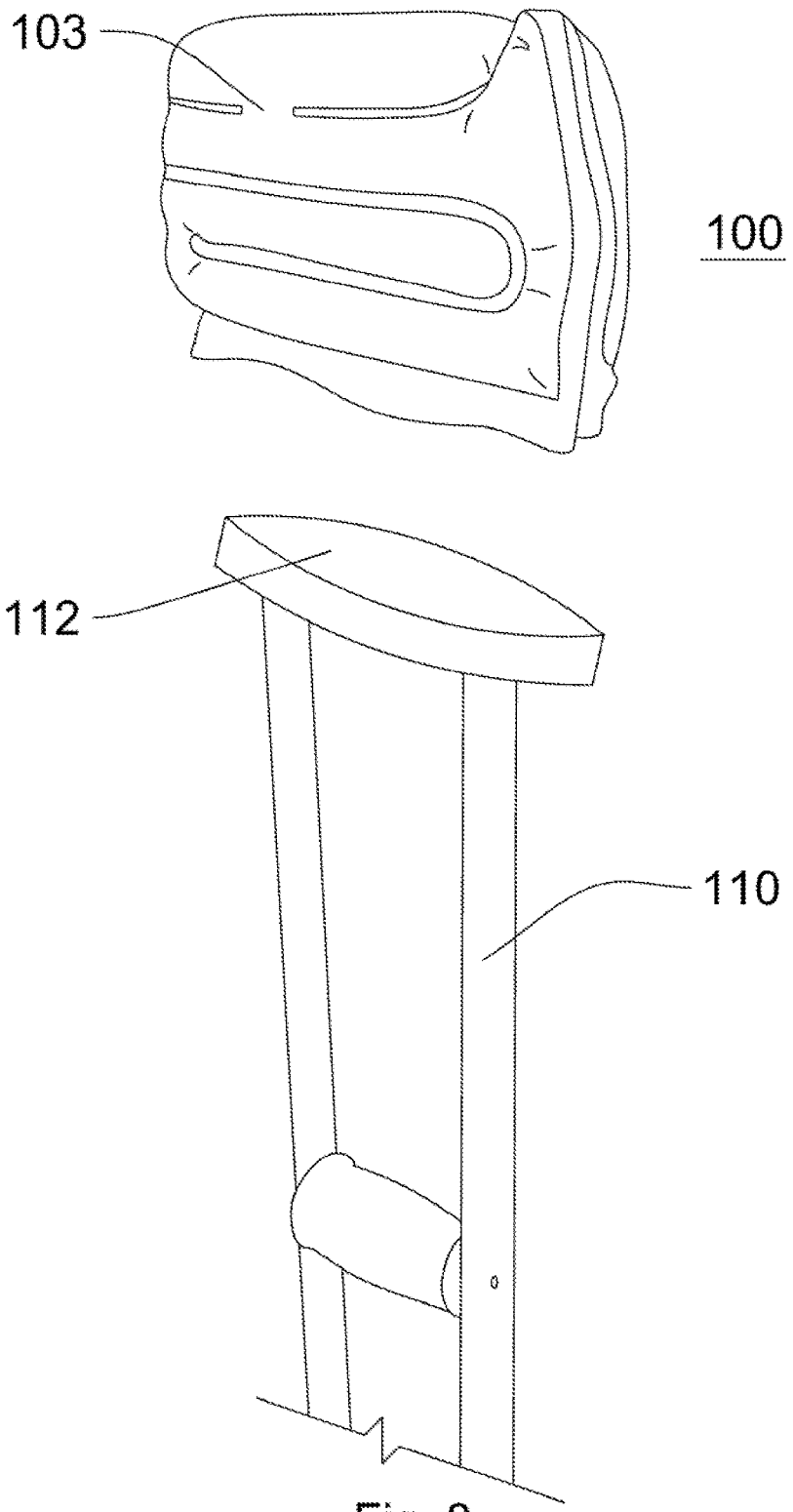
FIG. 8 is a front perspective view of the invention shown in FIG. 1 positioned above a standard crutch.
Figure 9:
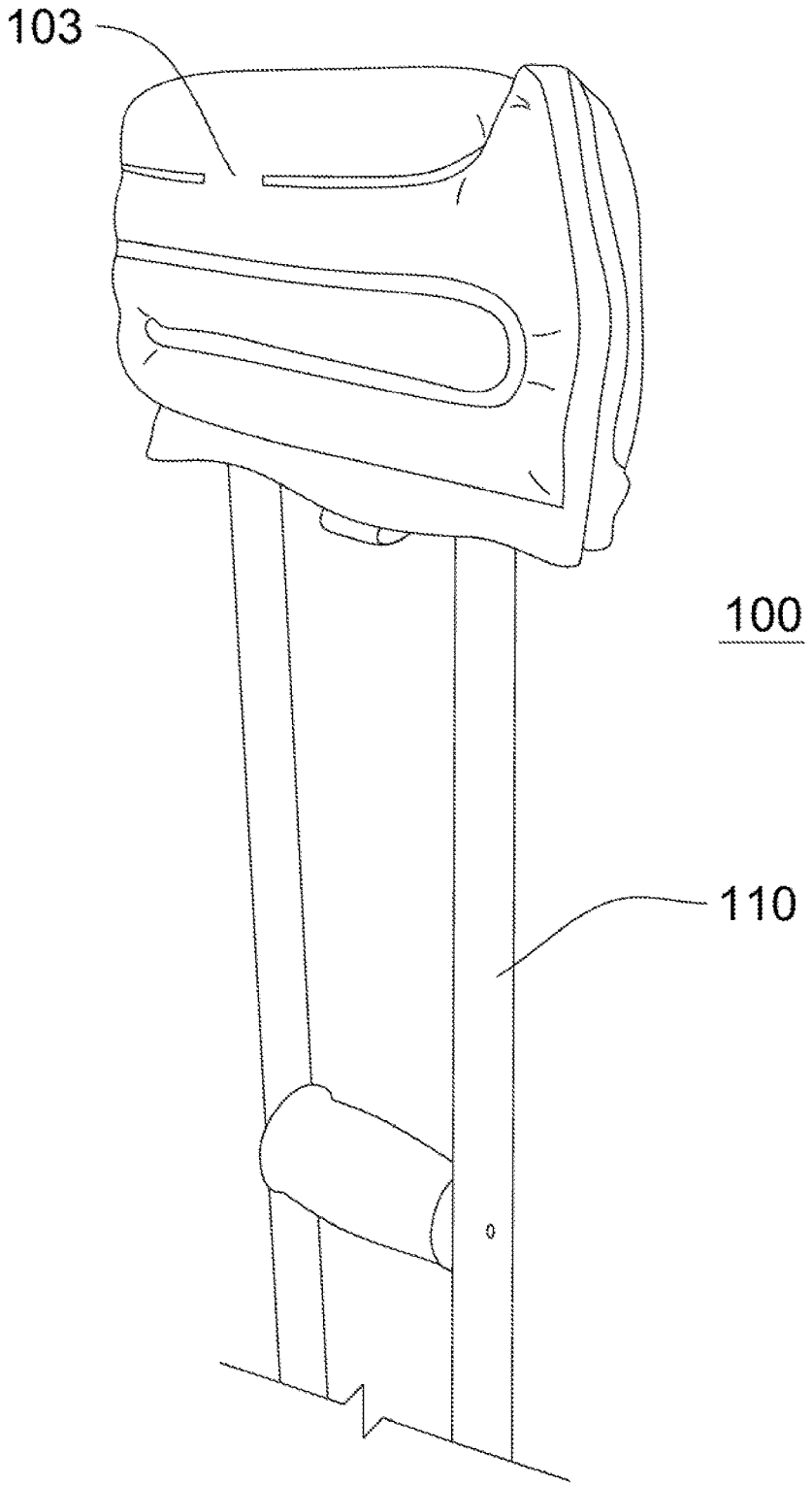
FIG. 9 is a front perspective view of the invention shown in FIG. 1 positioned on a standard crutch.

Adverting now to the figures, FIGS. 1-7 shows the inflatable housing 100. The inflatable housing 100 slides on top of a crutch 110, e.g. an axillary crutch shown in FIG. 8. In FIG. 9 shows that the inflatable housing 100, once inflated, is slid over the top of the crutch pad that is positioned underneath the user's armpit. The inflatable housing 100 is made from a thermoplastic polyurethane (TPU).

Inflatable housing 100 includes multiple air chambers that are shown in FIG. 1-7. Upper chamber 102 is at the top of the inflatable housing 100, while side chamber 104 is located on the sides of the inflatable housing. Upper chamber 102 is positioned to contact directly under the user's arm pit. Side chambers 104 are positioned next to the upper chamber 102 to provide a cushion for the user's inner arm and chest when the user is using the inflatable housing 100 on a crutch 110. The chambers are filled with air to provide a soft cushion between the crutch 110 and the user's armpit during use of the crutch.

The chambers are filled with air through valve 106. While air is a preferred medium, other gases and/or fluids can be used to fill upper chamber 102 and side chambers 104. The term medium is synonymous with air for the instant application to designate the gas or fluid that is within upper chamber 102 and side chambers 104. A manual compressor is used to fill the chambers through valve 106 by the user because the volume of air needed to fill the chambers is relatively low. A manual compressor is the preferred tool to fill the chambers to a user defined comfort level and to avoid overfilling the inflatable housing 100, which could cause the inflatable housing 100 to breach or burst from over pressure. Overfilling the inflatable housing 100 can terminally damage the device. However, other variations of compressors can be used with care not to exceed a maximum pressure threshold.

Valve 106 allows for the air to flow in and out of the upper chamber 102 and side chambers 104 of the inflatable housing 100. The inflatable housing 100 needs to be inflated prior to installation on top of the crutch pad. The valve 106 is set up in an open position, i.e. extended outward from the upper chamber 102 and is open to the environment. The user causes air to flow into the valve 106 and into the chambers (upper chamber 102 and side chamber 104). The pressure is increased inside the upper chamber 102 and side chambers 104 until the user stops the flow of air into valve 106.

Once the inflatable housing 100 is pressurized with air, valve 106 is pressed inward by the user to the closed position within upper chamber 102 to prevent air from exiting from the inflatable housing 100. Then, the user inserts the inflatable housing 100 over the top of the crutch 110 where the crutch pad 112 makes contact with the user's armpit. When the user attempts to walk with the assistance of the crutch 110 and inflatable housing 100, the pressure inside the inflatable housing may need adjustment based on the user's comfort preference. The pressure may be too low, not giving the user enough support between the inflatable housing 100 and the crutch pad 112. Alternatively, the pressure may be too high, giving the user enough too much support, i.e. a hard buffer, between the inflatable housing 100 and the crutch pad 112.

If the pressure inside the inflatable housing 100 needs to be modified, the user removes the inflatable housing 100 from the crutch 110, opens the nozzle 106, and increases or decreases the air pressure within the inflatable housing 100. This allows the user to find the best comfort level for the pressure within the inflatable housing 100. Each user will have a different preference based on comfort, fit, and support. The ability of the user to adjust the pressure of the inflatable housing 100 allows each user to create an optimal fit between their armpit and the crutch 110. Additional factors that may impact a user's preference for the amount of pressure within the inflatable housing 100 are, but not limited to: height, weight, muscular build, skin sensitively, and walking style.

Figure 7:
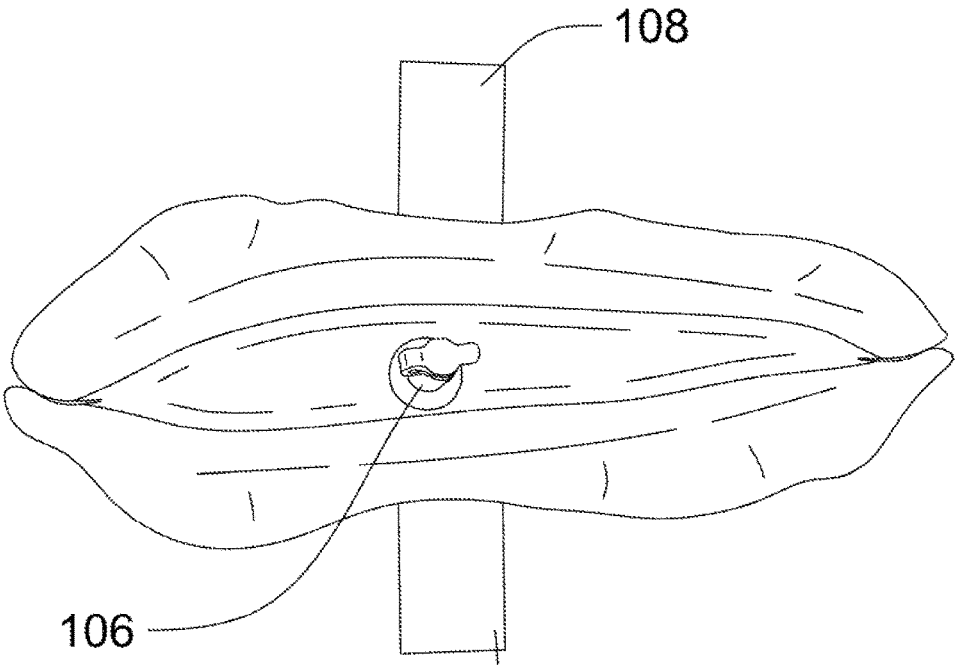
FIG. 7 is a bottom view of the invention shown in FIG. 1.
Figure 10:
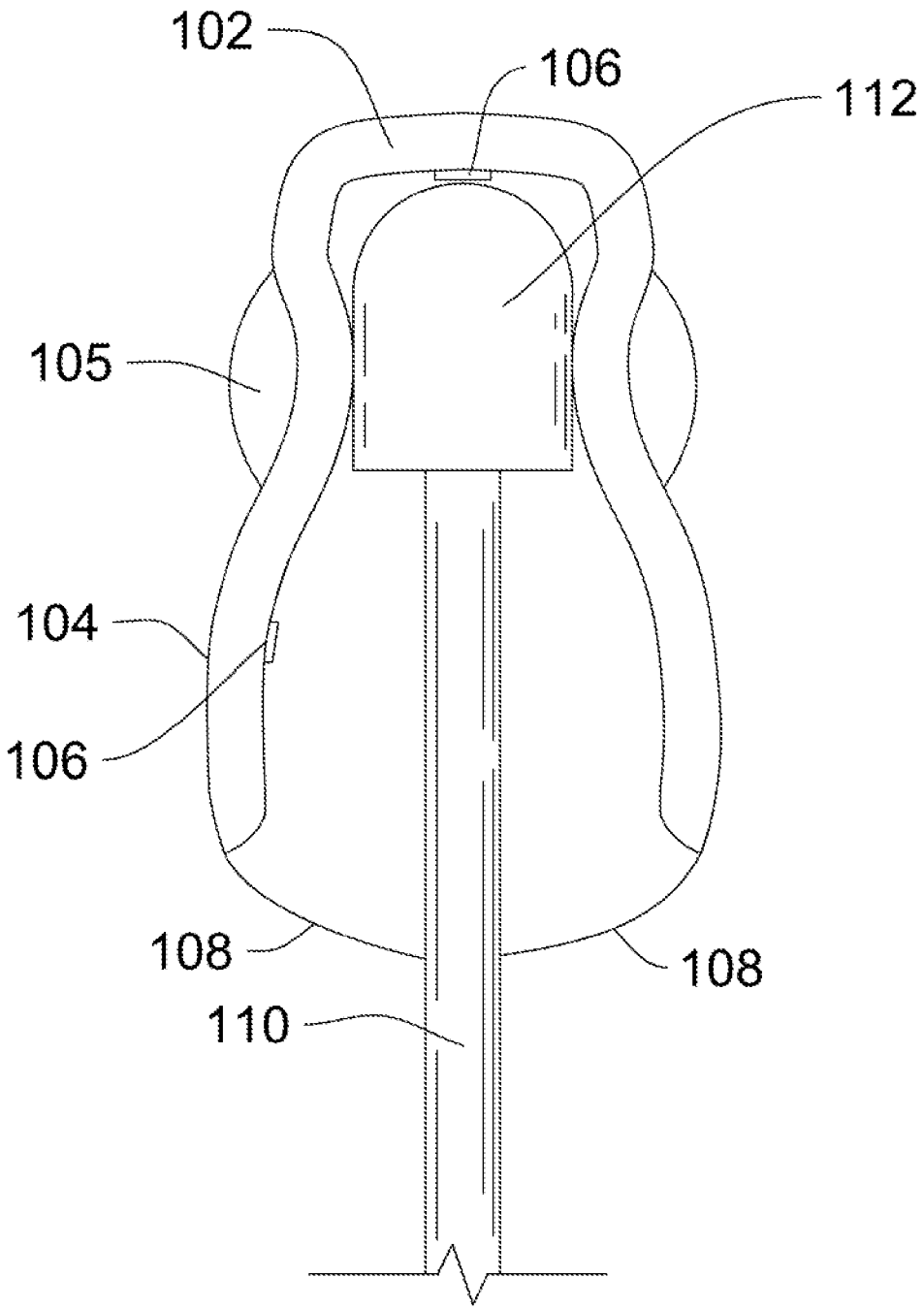
FIG. 10 is a side view of the invention shown in FIG. 1 positioned on a standard crutch.

As shown in FIG. 7, nozzle 106 is located on the inside of the inflatable housing 100. Upper chamber 102 has an outer surface on the outside of the inflatable housing 100. The outer surface is the portion of the inflatable housing 100 that contacts the user's armpit (or the clothing that covers the user's armpit). Upper chamber 102 also includes an inner surface on the inside of the inflatable housing 100. Best depicted in FIG. 7, nozzle 106 is positioned towards the center of the inner surface of the upper chamber 102. While the nozzle 106 is positioned in the center in FIG. 7, nozzle 106 can be located anywhere on the inside surface of upper chamber 102. As shown in FIG. 10, the inner surface of the upper chamber 102 contacts the top of the crutch pad 112 when the inflatable housing 100 is secured to the crutch 110.

The position of the nozzle 106 on the inner surface of the upper chamber 102 has several advantages. First, placing the nozzle 106 on the inner surface of the upper chamber 102 prevents the nozzle 106 from interacting, i.e. hitting, the user's arm while using the inflatable housing 100 is positioned on the crutch 110. If the nozzle 106 was located on the outside of the inflatable housing 100, it would come into contact with the user's armpit, chest, arm, or other part of his/her body. This would be uncomfortable for the user and cause irritation injury after prolonged use.

Second, the outward pressure on the nozzle 106 when the user is using the inflatable housing 100 on the crutch 110 needs to be considered. If the nozzle 106 was located on the outside of the inflatable housing 100, there is a greater chance of the nozzle 106 inadvertently opening during use. When the user places his/her weight on the inflatable housing 100 on the crutch 110, the weight of the user increases the outward force on the nozzle 106. However, as shown in FIG. 10, the top of the crutch pad 112 contacts nozzle 106 and the inner surface of upper chamber 102. When the user places his/her weight on the inflatable housing 100, the outward force exerted on nozzle 106 is balanced with the opposing force exerted by the top of the crutch pad 112 onto the inner surface of the upper chamber 102, which includes nozzle 106. By positioning the nozzle 106 on the inner surface of upper chamber 102, the top of the crutch pad 112 secures nozzle 106 in the closed, inward position on inflatable housing 100 during use on the crutch 110.

As shown in FIGS. 1-7, side chambers 104 are located on the sides of inflatable housing 100. Side chambers 104 extend downward from upper chamber 102. Upper chamber 102 and side chamber 104 are located are unitary features of the inflatable housing 100. The unitary nature of the device means that the various chambers are created on the same platform, with stitching or other seem joining mechanism to create the desired chamber configurations. The inflatable housing 100 is a unitary device, plus the addition of valve 106 and straps 108.

Side chambers 104 include a series of channels 105 where air resides, thereby creating cushioned support for the user. As shown in FIGS. 1 through 7, the channels 105 are routed in a snake pattern on side chambers 104. When air is inserted into valve 106, air fills the upper chamber 102 and the channels 105 of side chambers 104. Air passes into upper chamber 102 and the channels 105 of side chambers 104 through pockets 103. Pockets 103 are gaps in the seams between upper chamber 102 and the channels 105 of side chambers 104. The use of pockets 103 provides for a continuous path for the air to travel through upper chamber 102 and the channels 105 of side chambers 104.

Channels 105 of side chambers 104 are formed by heat sealing portions of the inflatable housing 100 to create the channels 105. As shown in FIGS. 1 through 7, the channels 105 form a snake pattern. In an exemplary embodiment, the channels 105 are formed using radio frequency (RF). The use of heat sealing or RF technology allows for a myriad of patterns and shapes for the channels 105 in the side chambers 104, not only a snake pattern.

While the inflatable housing 100 uses channels 105 designed as a snake pattern on side chambers 104, numerous configurations can be used to provide support for the user. In an exemplary embodiment, multiple channels are in a vertical, horizontal, and/or diagonal pattern with pockets 105 to connect the channels to all the other air chambers within the inflatable housing 100. In yet another exemplary embodiment, round or semi-spherical chambers are located on side chambers 104 with pockets 105 to provide the cushion for the user's chest and arms.

Figure 1:
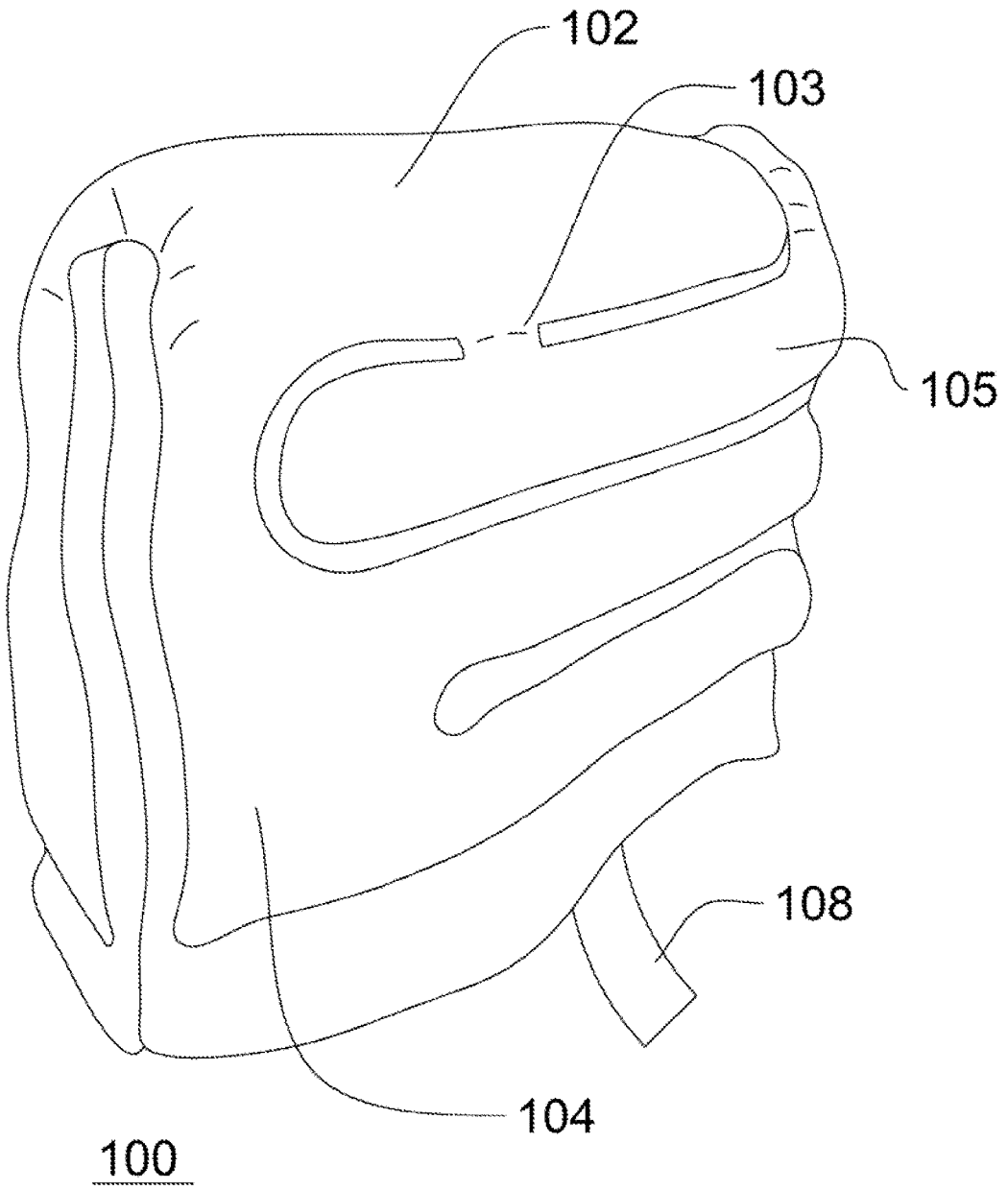
FIG. 1 is a front perspective view of the present invention.
Figure 2:
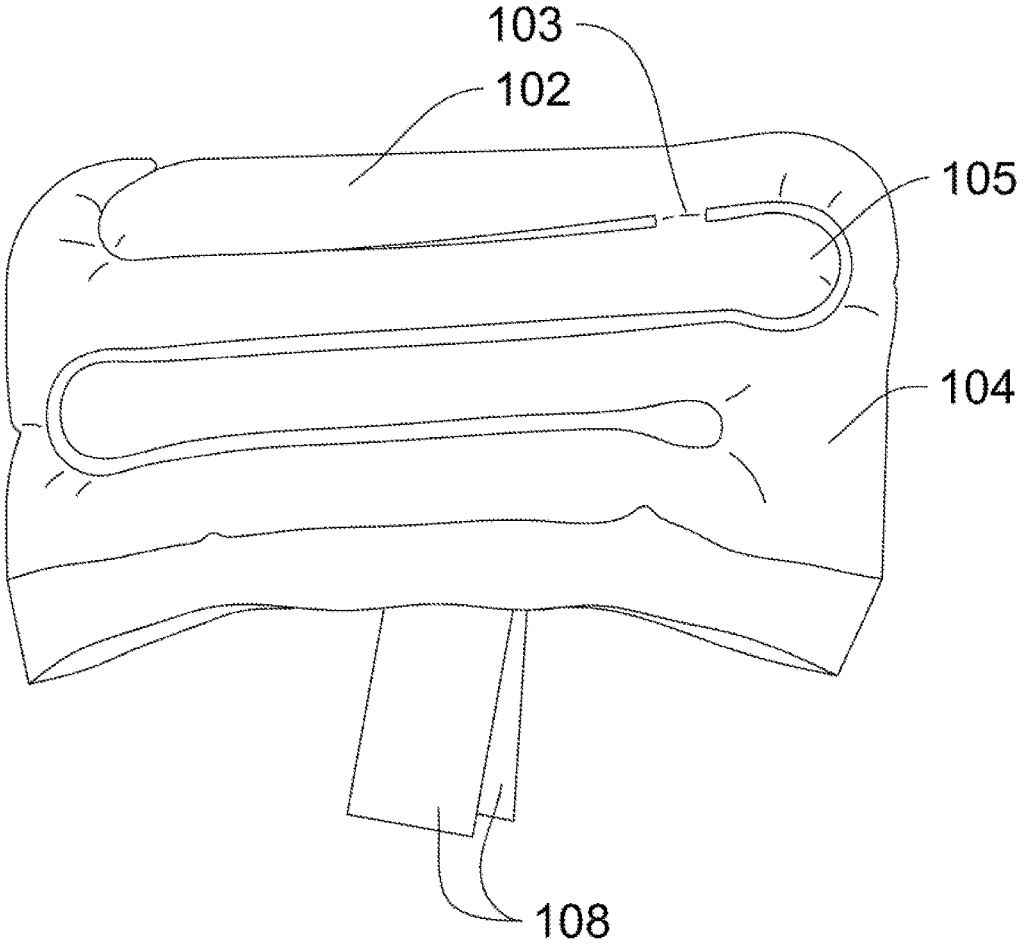
FIG. 2 is a front view of the invention shown in FIG. 1.
Figure 3:
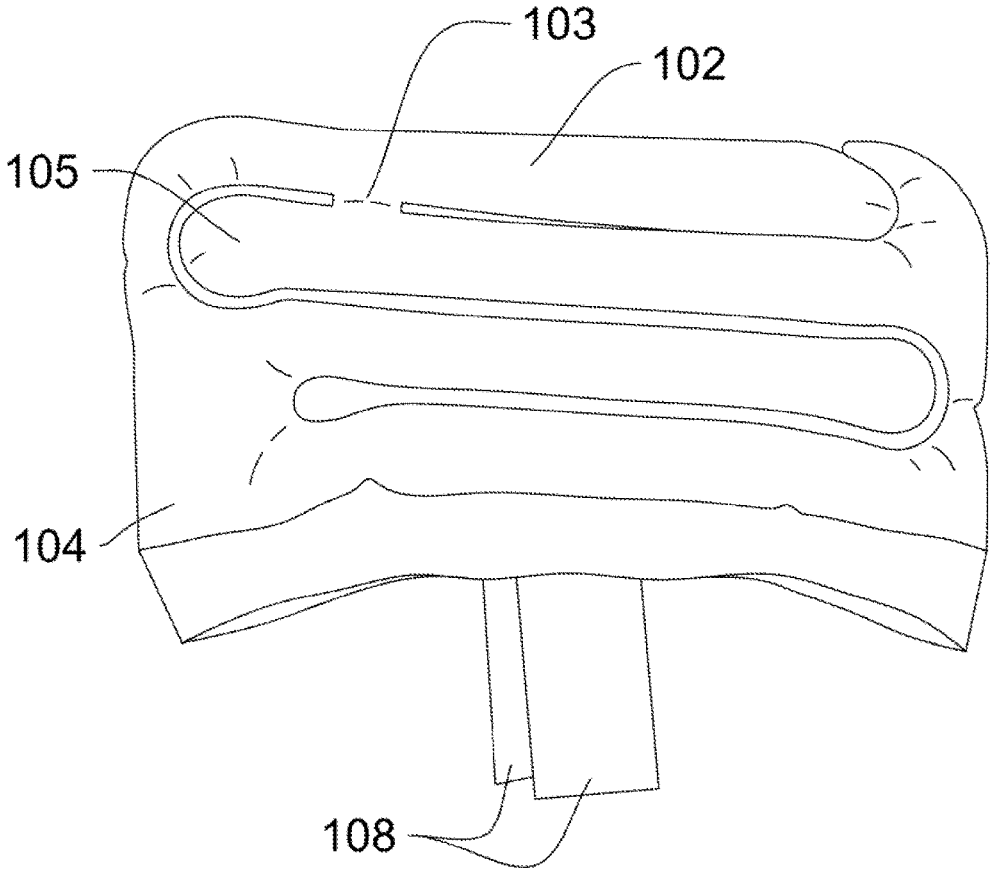
FIG. 3 is a back view of the invention shown in FIG. 1.
Figure 5:
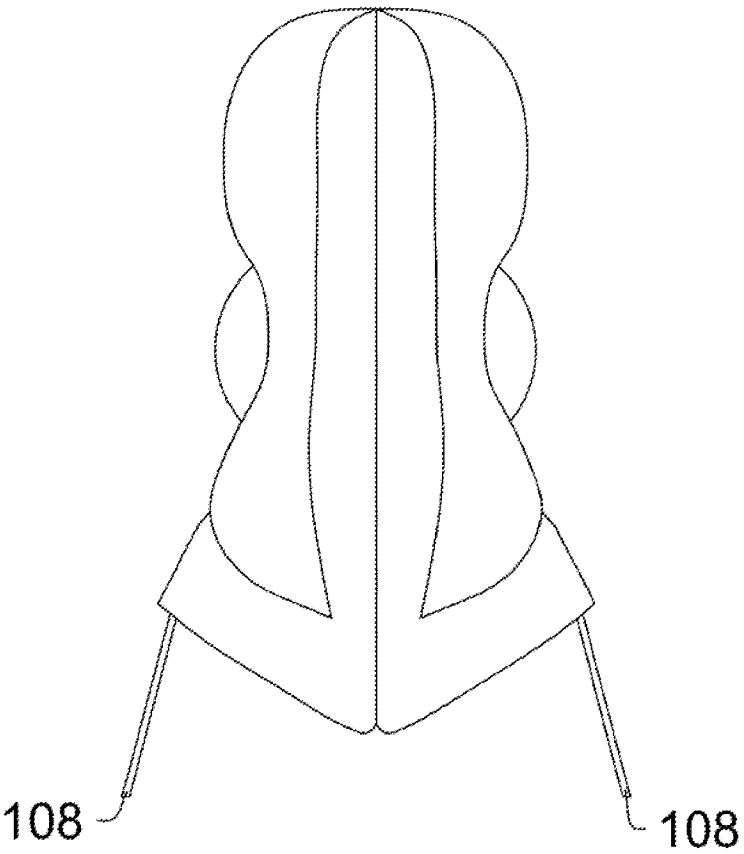
FIG. 5 is a right side view of the invention shown in FIG. 1.
Figure 4:
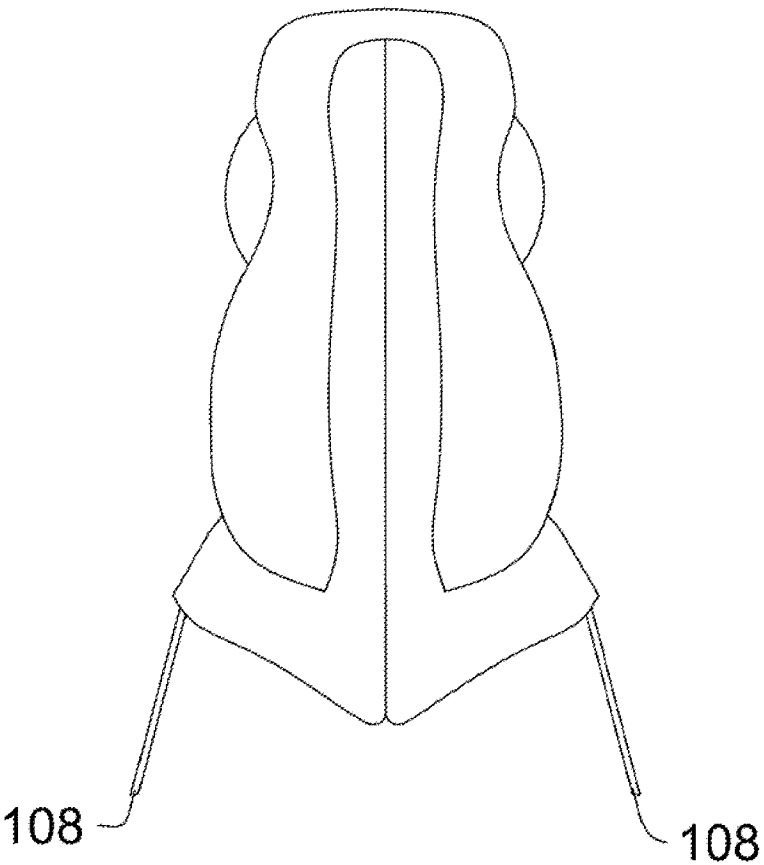
FIG. 4 is a left side view of the invention shown in FIG. 1.
Figure 6:
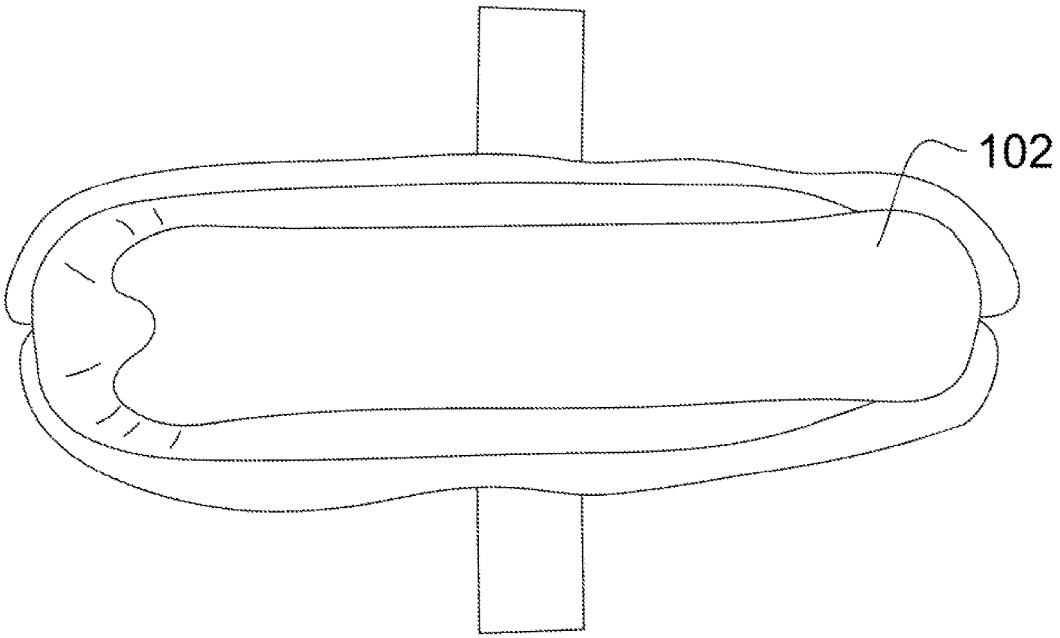
FIG. 6 is top view of the invention shown in FIG. 1.

When the inflatable housing 100 is inserted over the crutch pad 112, the bottom of the inflatable housing 100 is secured about crutch 110. As shown in FIGS. 3-5, straps 108 are connected to ensure the inflatable housing 100 is secure on crutch 110 and will not slide off the crutch 110 during operation by the user. The straps 108 on inflatable housing 100 uses a hook and loop type fastener to secure the inflatable housing 100 on the crutch. While a hook and loop type fastener is a common mechanism to secure the inflatable housing to the crutch, numerous other connection mechanisms can be used, such as but not limited to: snaps, a zipper, magnets, and safety pins.

In an exemplary embodiment, the inflatable housing 100 is pressurized by inserting air into an inflatable housing 100 through valve 106 located on an inner surface of the inflatable housing 100. As shown in FIG. 7, valve 106 is located on the inner surface of upper chamber 102. First, the valve 106 is open to allow air to pass through it. Next, air is inserted through valve 106 to fill upper chamber 102 and at least one side chamber 104 of the inflatable housing 100. Once filled, the valve 106 is closed and retracted into upper chamber 102. Next, the inflatable housing 100 is slid on top of crutch 110 and flush with crutch pad 112.

In yet another exemplary embodiment, shown in FIG. 10, valve 106 is located on each chamber in the inflatable housing 100. For example, valve 106 creates an air port in upper chamber 102 and a second valve 106 creates a separate air port in side chamber 104. In some configurations, the air chambers are not connected using pockets 103 and require independent air ports. When pockets 103 are not needed, the channels 105 are fully sealed using heat seal technology or RF. A valve 106 is used to inflate and deflate the fully sealed channel 105.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A crutch air cushion device, comprising:

a crutch;

a unitary inflatable housing that slides on top of the crutch, wherein the unitary inflatable housing comprises an upper chamber positioned on an upper surface of the crutch and at least one side chamber positioned to one side of the crutch;

the upper chamber has an outer surface on the outside of the inflatable housing and an inner surface on the inside of the inflatable housing; and at least one valve positioned on the inner surface of the upper chamber for air inlet and outlet, wherein said at least one valve is prevented from inadvertently opening during use by the top of the crutch.

2. The crutch air cushion device as recited in claim 1, further comprising a connection means to secure the inflatable housing to the crutch.

3. The crutch air cushion device as recited in claim 1, wherein:

each valve extends outward relative to the inflatable housing to allow the input or output of air, and each valve closes inward and is contracted relative to the inflatable housing to seal the air cushion device.

4. The crutch air cushion device as recited in claim 1, wherein the at least one side chamber includes a channel pattern.

5. The crutch air cushion device as recited in claim 1, wherein each valve permits the flow of air into the upper chamber and the connected at least one side chamber.

6. The crutch air cushion device as recited in claim 1, wherein the inflatable housing comprises two side chambers.

7. The crutch air cushion device as recited in claim 6, wherein the side chambers comprise a channel pattern.

8. The crutch air cushion device as recited in claim 1, wherein a second valve is connected to the at least one side chamber.

* * * * *